US010988295B1

(12) United States Patent
Ludwig

(10) Patent No.: US 10,988,295 B1
(45) Date of Patent: Apr. 27, 2021

(54) POUCH FLIP-TOP FOR BUBBLE VALVE APPLICATIONS

(71) Applicant: Christopher Ludwig, Buffalo Grove, IL (US)

(72) Inventor: Christopher Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 33 days.

(21) Appl. No.: 16/621,798

(22) PCT Filed: Jun. 14, 2018

(86) PCT No.: PCT/US2018/037461
§ 371 (c)(1),
(2) Date: Dec. 12, 2019

(87) PCT Pub. No.: WO2018/232066
PCT Pub. Date: Dec. 20, 2018

Related U.S. Application Data

(60) Provisional application No. 62/520,135, filed on Jun. 15, 2017, provisional application No. 62/545,229, filed on Aug. 14, 2017.

(51) Int. Cl.
*B65D 47/20* (2006.01)
*B65D 75/58* (2006.01)
*B65D 83/00* (2006.01)

(52) U.S. Cl.
CPC ..... *B65D 75/5822* (2013.01); *B65D 47/2018* (2013.01); *B65D 75/5866* (2013.01); *B65D 83/0055* (2013.01)

(58) Field of Classification Search
CPC ..... B65D 75/5822; B65D 75/5866; B65D 47/2018; B65D 83/0055
See application file for complete search history.

(56) References Cited

U.S. PATENT DOCUMENTS

| | | | | |
|---|---|---|---|---|
| 3,184,121 | A * | 5/1965 | Volckening ..... | B65D 75/5811 222/213 |
| 3,217,934 | A | 11/1965 | Schneider et al. | |
| 4,592,493 | A * | 6/1986 | Smith ..... | B65D 47/2031 222/212 |
| 5,207,355 | A | 5/1993 | Thomsen | |
| 6,575,330 | B2 * | 6/2003 | Rousselet ..... | B65D 47/2018 222/1 |

(Continued)

FOREIGN PATENT DOCUMENTS

| | | |
|---|---|---|
| CN | 2905677 | 5/2007 |
| EP | 1 162 155 | 12/2001 |

(Continued)

OTHER PUBLICATIONS

International Search report issued in PCT/US/2018/037461 dated Oct. 17, 2018.

*Primary Examiner* — Frederick C Nicolas
(74) *Attorney, Agent, or Firm* — McCarter & English, LLP

(57) ABSTRACT

The present disclosure relates to a bubble valve for flexible containers wherein the bubble valve can be in a first configuration wherein a hinged header or flip-top is in a straight configuration and the valve is closed, or in a second configuration wherein the hinged header or flip-top is pulled back and the valve permits fluid flow.

20 Claims, 5 Drawing Sheets

(56) References Cited

U.S. PATENT DOCUMENTS

| | | | | |
|---|---|---|---|---|
| 6,732,889 | B2 * | 5/2004 | Oren | B65D 5/748 222/494 |
| 7,207,717 | B2 | 4/2007 | Steele | |
| 7,883,268 | B2 | 2/2011 | Steele | |
| 8,613,547 | B2 | 12/2013 | Steele | |
| 9,963,284 | B2 | 5/2018 | Steele | |
| 10,301,093 | B2 * | 5/2019 | Steele | B65D 33/01 |
| 2010/0008602 | A1 * | 1/2010 | Risgalla | B65D 75/5822 383/44 |
| 2010/0051646 | A1 * | 3/2010 | Castillo | B65D 75/5822 222/107 |
| 2013/0221037 | A1 * | 8/2013 | Klenovich | B65D 35/00 222/420 |
| 2020/0062465 | A1 * | 2/2020 | Ludwig | B65D 75/5883 |
| 2020/0189810 | A1 * | 6/2020 | Ludwig | B65D 47/2018 |

FOREIGN PATENT DOCUMENTS

| | | |
|---|---|---|
| EP | 1 577 223 | 9/2005 |
| WO | 2016/164185 | 10/2016 |
| WO | 2018/232066 | 12/2018 |

* cited by examiner

POUCH FLIP-TOP FOR BUBBLE VALVE APPLICATIONS

This application is a National Phase of Application No. PCT/US2018/037461 filed on Jun. 14, 2018 which claims priority of U.S. Provisional Application Ser. No. 62/520,135, filed on Jun. 15, 2017, and U.S. Provisional Application Ser. No. 62/545,229, filed on Aug. 14, 2017, the contents of the disclosure of both of which are incorporated by reference herein for all purposes.

BACKGROUND OF THE DISCLOSURE

Field of the Disclosure

The present disclosure relates to a bubble valve for flexible containers wherein the bubble valve can be in a first configuration wherein a hinged header or flip-top is in a straight configuration and the valve is closed, or in a second configuration wherein the hinged header or flip-top is pulled back and the valve permits fluid flow.

Description of the Prior Art

Prior art packaging in the food/beverage, personal care and household care industries is primarily a combination of a rigid bottle or semi-flexible tube with a rigid fitment or cap of varying dispense types. Transition to flexible pouches for the main body of the container has continued to utilize similar, still rigid, fitments. There exists a need within these industries to complete the transition in order to create a fully flexible solution, particularly with respect to bubble valve or pressure-activated applications.

Bubble valves or pressure-activated valves may be creating by forming a bubble of air, gas or other liquid between a base layer and a bubble layer. A flow channel is formed between the bubble layer and a channel layer. The pressure of the bubble layer against the channel layer may be used to control the flow of the dispensed material. Representative embodiments of a bubble valve or a pressure-activated valve are disclosed in U.S. Pat. No. 9,963,284 entitled "Package Valve Closure System and Method," issued on May 8, 2018 to Steele; U.S. Pat. No. 8,613,547 entitled "Packages Having Bubble-Shaped Closures," issued on Dec. 24, 2013 to Steele; U.S. Pat. No. 7,883,268 entitled "Package Having a Fluid Actuated Closure," issued on Feb. 8, 2011 to Steele; U.S. Pat. No. 7,207,717 entitled "Package Having a Fluid Actuated Closure," issued on Apr. 24, 2007 to Steele.

OBJECTS AND SUMMARY OF THE DISCLOSURE

It is therefore an object of the present disclosure to improve functionality by representing both a flow control mechanism and re-close feature, thereby enhancing the overall sustainability profile and cost reduction of the packaging through material reduction and operational efficiency gains.

This and other objects are attained by providing a bubble valve for flexible containers wherein the bubble valve can be in a first configuration wherein a flip-top or header is in a straight configuration and the valve is closed, or in a second configuration wherein the flip-top or header is folded or pulled back and the valve permits fluid flow. While the containers, as well as the bubble valve or pressure-actuated valve, are made of somewhat flexible material, the containers and the material surrounding the bubble valves or pressure-actuated valves may be sufficiently rigid to allow the package to maintain an upright position, and the valve to be definitively moved between the first and second configurations.

The disclosed embodiments relate to bubble valves and relate to geometry that is incorporated into the pouch material thereby creating a configuration similar to the flip-top cap prevalent in rigid packaging fitments but in an integrated, flexible format. Integral to the concept is the geometry and dimensions of two differing designs on the two layers of pouch material.

The user typically splits open one side of the pouch by pressing back on the upper area of the pouch which, in the past, may have included a tear-off header. The second layer of pouch film would include a hinge mechanism/perforation pattern to allow the header to tilt back and lock into a folded configuration while the product is being dispensed. When the user is done, the header, can be brought back to the original unfolded position to cover the valve tip.

This feature can be used in any combination with various bubble valves to provide multiple layers of protection against product leakage and improved appearance/form factor specifically when used in circumstances where portability of the container, pouch or package is desired.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 3:
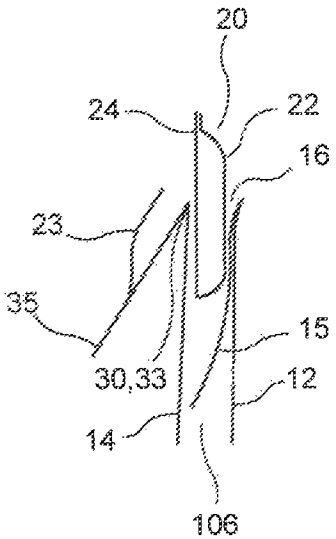
FIG. 3 is a cross-sectional view along plane 3-3 of FIG. 2.
Figure 2:
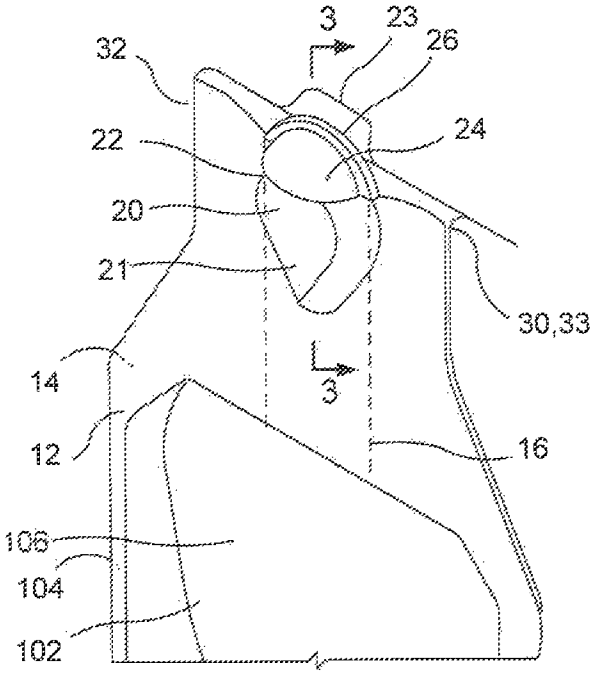
FIG. 2 is a perspective view, partially in phantom, illustrating the bubble valve of the present disclosure in a folded or pulled-back configuration.
Figure 1:
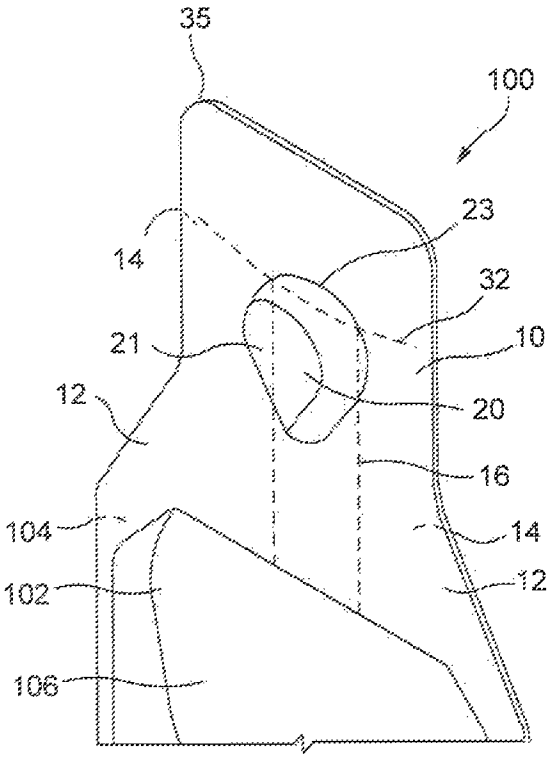
FIG. 1 is a perspective view, partially in phantom, illustrating the bubble valve of the present disclosure in an unfolded or closed configuration.

Referring now to the drawings in detail, one sees from FIGS. 1 and 2, the respective closed and open configurations of a first embodiment of the package 100 and bubble valve 10. The package 100 includes first and second package walls 102, 104, with a storage volume 106 therebetween, with the valve 10 providing an outlet 16 (illustrated in phantom) to communicate contents from the storage volume 106 to the exterior of the package 100 during dispensing. The outlet 16 is a closed or blocked configuration in FIG. 1 and in a valve-controlled open configuration in FIG. 2. The valve 10 includes first and second valve walls 12, 14 of semi-rigid or semi-flexible material. First and second valve walls 12, 14 are generally planar, co-extensive and facing each other.

First and second valve walls 12, 14 are sealed or joined to each other except for the outlet 16. First wall 12 further includes an enlarged protrusion 20 which at least partially surrounds the bubble 22 (configured as a protruding valve element). Bubble 22 is filled with air, gas or other fluid and includes an outwardly curved face 24 which forms a bubble layer for the bubble valve configuration and a planar face 26 which is sealed to second valve wall 14 thereby acting as a base layer for the bubble valve configuration. Outlet 16 is formed, in part, by channel layer 15 being at least partially unsealed to, and passing over, bubble 22. Channel layer 15 is sealed to the interior of first valve wall 12 and is formed as part of the structure of the valve 10. Upper portion 23 of enlarged protrusion 20 is likewise unsealed to bubble 22 thereby allowing the upper portion 23 of enlarged protrusion 20 to hingeably move from the unfolded position in FIG. 1 to the folded position in FIG. 2. Hinge/Hinge element 30 is formed by a first lateral line of weakness 32 across first valve wall 12, dividing enlarged protrusion 20 into lower and upper portions 21, 23, defining header 35, and leaving second valve wall 14 at least substantially intact, typically with a second lateral line of weakness 33 (such as, but not limited to, a score line or a perforated line) co-extensive or aligned with first lateral line of weakness 32 to define and delineate the hinging or folding movement of the header 35 (formed from a portion of first and second valve walls 12, 14) between the open and closed positions of FIGS. 1 and 2, respectively. In the configuration of FIG. 1, which represents the closed configuration (wherein the header 35 obstructs the outlet 16) which may be presented to a consumer at a shopping location, the first lateral line of weakness 32 is typically intact to maintain hermeticity, but is frangible and easily broken when the user opens the valve 10 by operating the hinge 30 and moving the header 35, and hence the bubble valve 10, to the open configuration of FIG. 2 wherein the outlet 16 is free of obstruction by the header 35. The user may move the header 35 from the configuration of FIG. 2 to the configuration of FIG. 1, typically after dispensing a portion of the product from storage volume 106.

The pressing action of the bubble 22 against the lower portion 21 of enlarged protrusion 20 acts a valve for the dispensing of material from the storage volume 106. The pressure or pressing action can be increased by the user manually pushing on the bubble 22. In the open configuration illustrated in FIG. 2, the pressure or pressing action may be overcome by the user manually pressing on the storage volume 106 thereby forcing material from the storage volume 106 so as to be dispensed through the outlet 16.

Figure 4A:
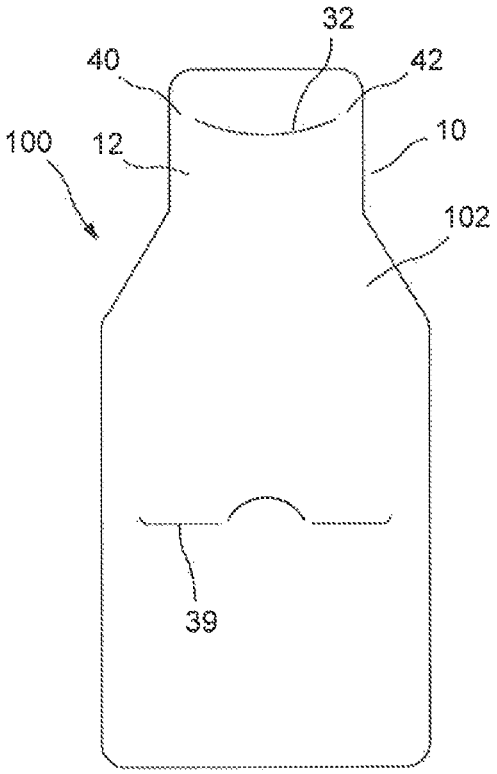
FIGS. 4A and 4B are plan views of the pouch front (pull tab) slit variations of embodiments of the present disclosure.
Figure 4B:
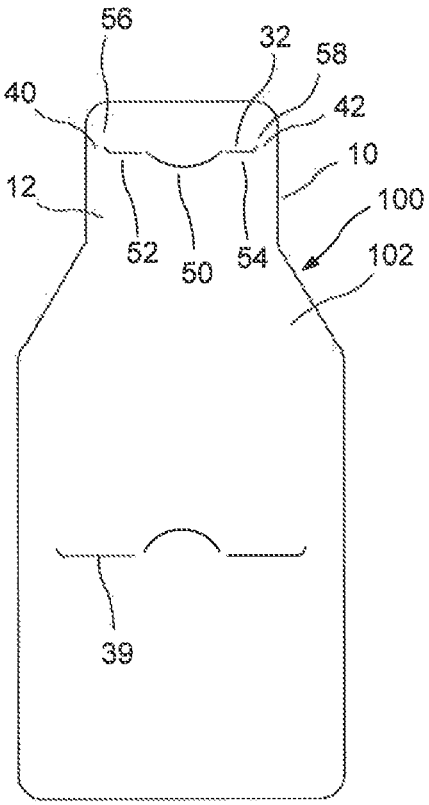

FIG. 4A illustrates an embodiment wherein the first lateral line of weakness 32, as shown from the front (i.e., on first valve wall 12) is crescent-shaped and extends across only a portion of valve 10 thereby requiring the user to crease the first and second laterally adjacent portions 40, 42 of the valve 10 when header 35 is moved to the open position. FIG. 4B illustrates first lateral line of weakness 32 with an central crescent portion 50, lateral straight portions 52, 54 and upturned ends 56, 58. Moreover, FIGS. 4A and 4B illustrate a receiving pocket 39 formed on first package wall 102 for receiving the valve 10 when the first and second package walls 102, 104 of package 100 are folded (see FIGS. 8A and 8B).

Figures 5A, 5B, 5C, 5D:
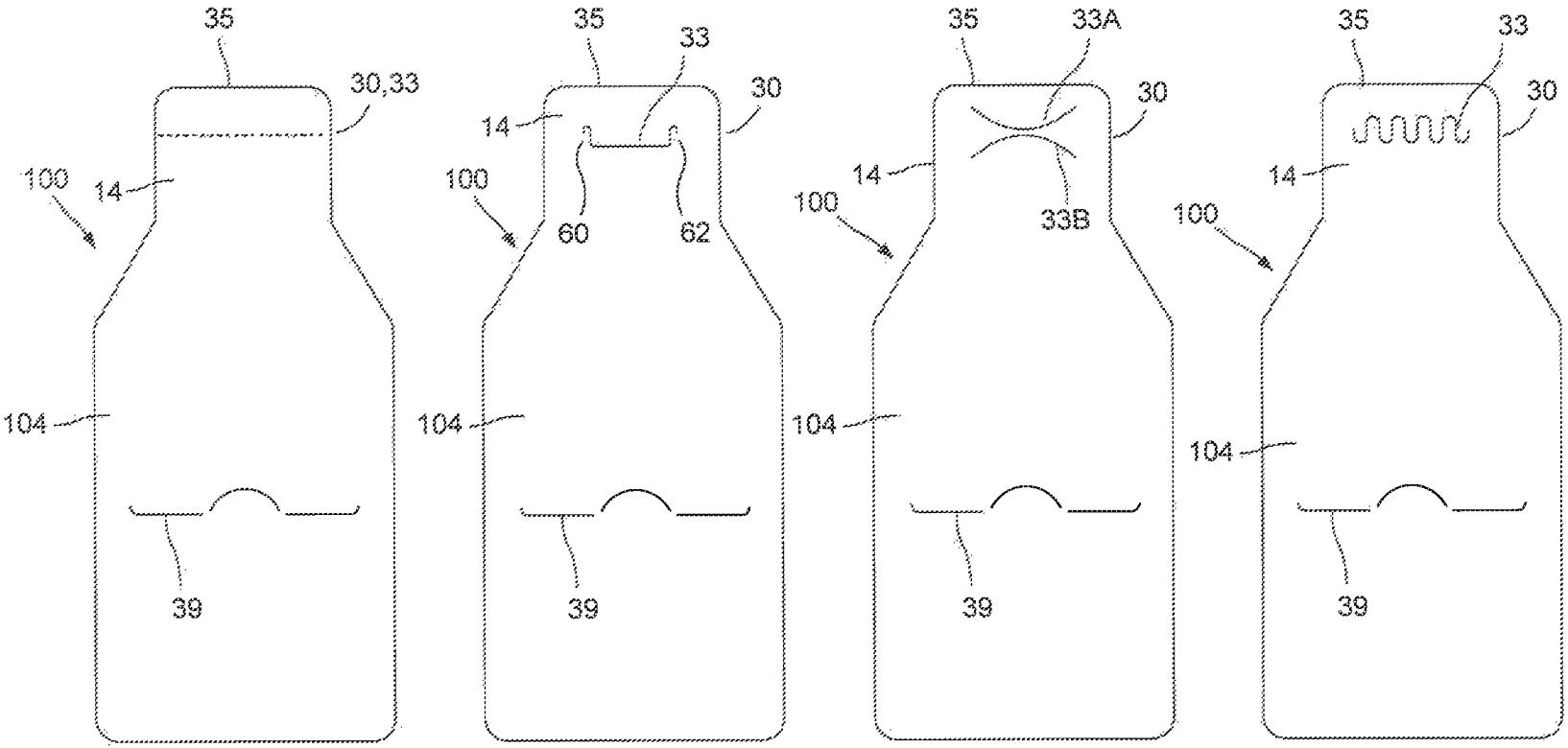
FIGS. 5A, 5B, 5C and 5D are plan views of pouch rear (hinge) slit variations.

FIGS. 5A, 5B, 5C and 5D illustrate variations of the second lateral line of weakness 33 forming hinge 30 on second valve wall 14, delineating header 35. FIG. 5A illustrates the second lateral line of weakness 33 extending straight across the entire valve structure 10, as illustrated in FIGS. 1 and 2. FIG. 5B illustrates the second lateral line of weakness 33 extending partially along valve structure 10 and terminating by upturned outwardly facing hook structures 60, 62, not extending fully to the edges of valve structure 10, thereby forming hinge 30. FIG. 5C illustrates upwardly turned line of weakness 33A above downwardly turned line of weakness 33B, not extending fully to the edges of valve structure 10, thereby forming hinge 30. FIG. 5D illustrates a substantially sinusoidally-shaped second lateral line of weakness 33, not extending fully to the edges of valve structure 10, thereby forming hinge 30. As illustrated, the second package wall 104 may likewise include a receiving pocket 39.

Figure 6A:
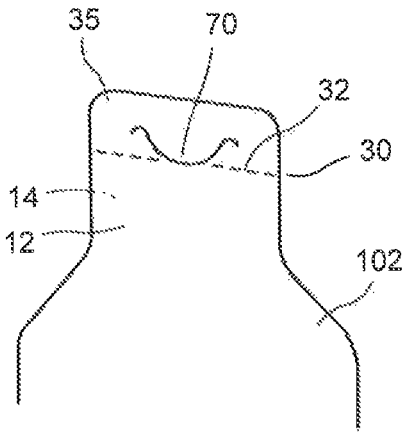
FIGS. 6A and 6B are front views of respective closed and open configuration of a further embodiment of the pouch of the present disclosure.
Figure 6B:
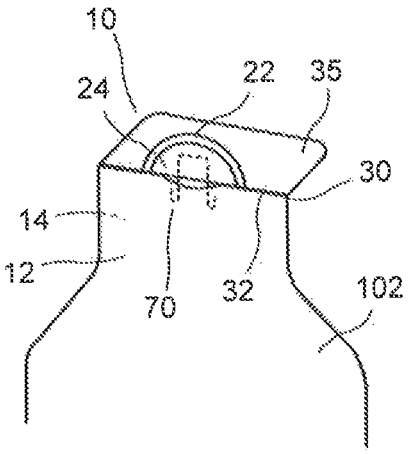

FIGS. 6A, 6B, 7A and 7B illustrate configurations wherein a tab or similar structure is incorporated into one of the first or second valve walls 12, 14 in order to support the header 35 in the folded or open position. FIG. 6A, which is a front view, illustrates an upwardly curved tab-line 70 which is formed in the first valve wall 12, generally above and tangentially meeting first lateral line of weakness 32. When the header 35 is moved from the unfolded or closed position, to the folded or open position, along hinge 30, as shown in FIG. 6B, which is likewise a front view, a portion of the first valve wall 12, as delineated by curved tab-line 70, rises and abuts planar face 26 of bubble 22, thereby supporting header 35 in the open position.

Figure 7A:
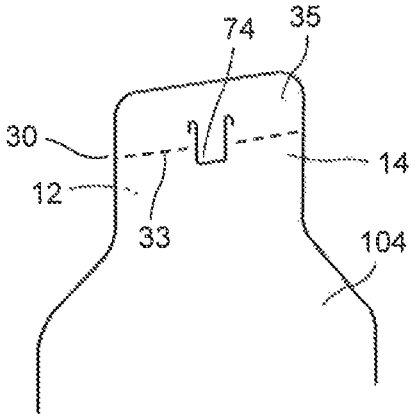
FIGS. 7A and 7B are rear views of respective closed and open configurations of a still further embodiment of the pouch of the present disclosure.
Figure 7B:
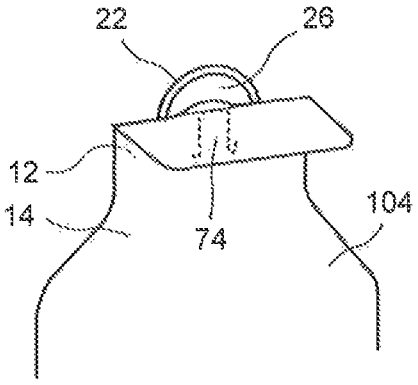

FIG. 7A is a rear view of embodiment including flap 74 formed on second valve wall 14, joined to second valve wall 114 above second lateral line of weakness 33, and extending downwardly across second lateral line of weakness 33. When header 35 is moved to the folded or open position, as shown in FIG. 7B, which is likewise a rear view, flap 74 lifts, inverts, and abuts a portion of second package wall 104 below second lateral line of weakness 33, thereby supporting header 35 in the open position.

Figure 8B:
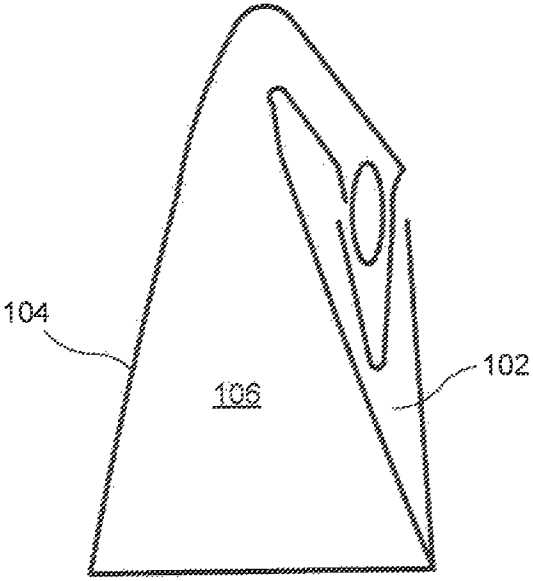
FIGS. 8A and 8B are side views of the package or pouch itself in respective unfolded and folded positions.
Figure 8A:
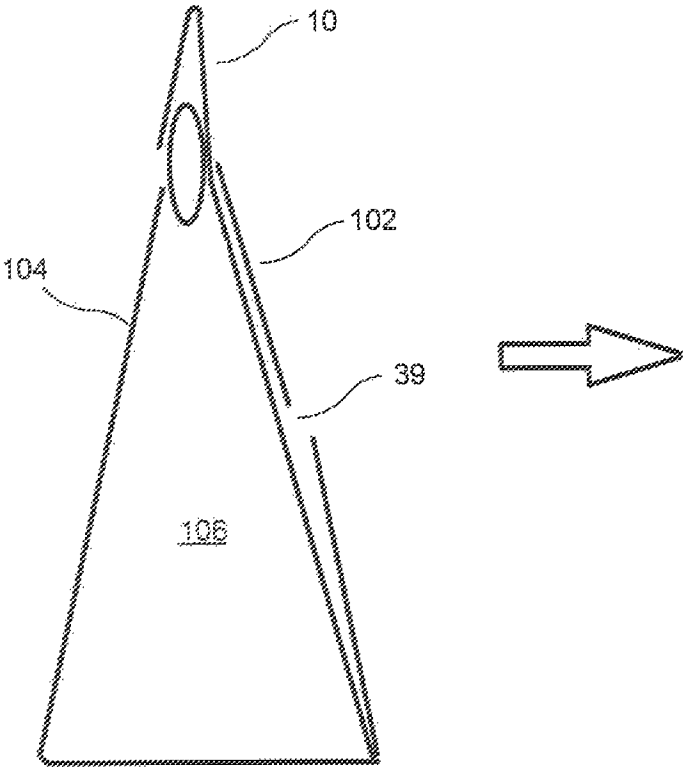

FIG. 8A illustrates the package 100 wherein the package walls 102, 104 are unfolded, while FIG. 8B illustrates the package 100 wherein the package walls 102, 104 have been folded so that the valve 10 is inserted into receiving pocket 39.

Thus the several aforementioned objects and advantages are most effectively attained. Although preferred embodiments of the invention have been disclosed and described in detail herein, it should be understood that this invention is in no sense limited thereby.

What is claimed is:

1. A valve comprising:

a first valve wall;

a second valve wall;

the first valve wall and the second valve wall being selectively joined together to form a fluid communication channel;

a protruding valve element joined to the second valve wall and extending into the fluid communication channel, wherein a portion of the fluid communication channel is formed between the protruding valve element and the first valve wall;

a hinge element formed on the second valve wall, thereby defining a hinged header, the hinge element being positioned so that a first portion of the protruding valve element is below the hinge element and a second portion of the protruding valve element is above the hinge element;

the hinged header having a first configuration wherein the header obstructs the fluid communication channel and a second configuration wherein the fluid communication channel is free of obstruction by the hinged header.

2. The valve of claim 1 wherein the first valve wall includes an enlarged portion for covering the protruding valve element.

3. The valve of claim 2 wherein the first valve wall includes a first line of weakness, the first line of weakness being frangible in response to movement of the header.

4. The valve of claim 3 wherein the hinge element includes a second line of weakness.

5. The valve of claim 4 wherein the first line of weakness is at least partially aligned with the second line of weakness.

6. The valve of claim 5 wherein the protruding valve element is a bubble element.

7. The valve of claim 6 wherein the bubble element is filled with air, gas or liquid.

8. The valve of claim 7 wherein the bubble element includes an outwardly curved face, received by the enlarged portion of the first valve wall, and a planar face, attached to an interior of the second valve wall.

9. The valve wall of claim 8 wherein the first line of weakness passes through the enlarged portion of the first valve wall.

10. The valve wall of claim 9 wherein the hinge element is in unfolded in the first configuration and folded in the second configuration.

11. A pouch or package comprising:

a first package wall;

a second package wall secured to the first package wall, thereby forming a storage volume therebetween;

a fluid communication channel communicating from the storage volume to an exterior of the package;

a valve in the fluid communication channel, the valve including:

a first valve wall joined to the first package wall;

a second valve wall joined to the second package wall;

the first valve wall and the second valve wall being selectively joined together to form at least a portion of the fluid communication channel;

a protruding valve element joined to the second valve wall and extending into the fluid communication channel, wherein a portion of the fluid communication channel is formed between the protruding valve element and the first valve wall;

a hinge element formed on the second valve wall, thereby defining a hinged header, the hinge element being positioned so that a first portion of the protruding valve element is below the hinge element and a second portion of the protruding valve element is above the hinge element;

the hinged header having a first configuration wherein the header obstructs the fluid communication channel and a second configuration wherein the fluid communication channel is free of obstruction by the hinged header.

12. The pouch or package of claim 11 wherein the first valve wall includes an enlarged portion for covering the protruding valve element.

13. The pouch or package of claim 12 wherein the first valve wall includes a first line of weakness, the first line of weakness being frangible in response to movement of the header, and wherein the hinge element includes a second line of weakness.

14. The pouch or package of claim 13 wherein the first package wall includes a receiving pocket for receiving the valve when the first and second package walls are folded.

15. The pouch or package of claim 14 wherein the first line of weakness is at least partially aligned with the second line of weakness.

16. The pouch or package of claim 15 wherein the protruding valve element is a bubble element.

17. The pouch or package of claim 16 wherein the bubble element is filled with air, gas or liquid.

18. The pouch or package of claim 17 wherein the bubble element includes an outwardly curved face, received by the enlarged portion of the first valve wall, and a planar face, attached to an interior of the second valve wall.

19. The pouch of package of claim 18 wherein the first line of weakness passes through the enlarged portion of the first valve wall.

20. The pouch or package of claim 19 wherein the hinge element is in unfolded in the first configuration and folded in the second configuration.

* * * * *